US009536660B2

(12) United States Patent
Park et al.

(10) Patent No.: US 9,536,660 B2
(45) Date of Patent: Jan. 3, 2017

(54) CHIP ELECTRONIC COMPONENT AND METHOD OF MANUFACTURING THE SAME

(71) Applicant: SAMSUNG ELECTRO-MECHANICS CO., LTD., Suwon-Si, Gyeonggi-Do (KR)

(72) Inventors: Moon Soo Park, Suwon-Si (KR); Tae Young Kim, Suwon-Si (KR); Dong Hwan Lee, Suwon-Si (KR)

(73) Assignees: HYUNDAI MOTOR COMPANY, Seoul (KR); KIA MOTOR CORPORATION, Seoul (KR)

( * ) Notice: Subject to any disclaimer, the term of this patent is extended or adjusted under 35 U.S.C. 154(b) by 105 days.

(21) Appl. No.: 14/478,728

(22) Filed: Sep. 5, 2014

(65) Prior Publication Data

US 2015/0371752 A1 Dec. 24, 2015

(30) Foreign Application Priority Data

Jun. 24, 2014 (KR) ..... 10-2014-0077155

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 27/02*** | (2006.01) |
| ***H01F 41/04*** | (2006.01) |

(Continued)

(52) U.S. Cl.

CPC ..... *H01F 41/046* (2013.01); *H01F 17/0013* (2013.01); *H01F 27/255* (2013.01); *H01F 27/292* (2013.01); *H01F 2003/106* (2013.01); *H01F 2017/0066* (2013.01); *Y10T 29/49075* (2015.01)

(58) Field of Classification Search

CPC .. H01F 41/046; H01F 17/0013; H01F 27/255; H01F 2003/106; H01F 27/2804; Y10T 29/49075

USPC ..... 336/200, 232, 234, 192

See application file for complete search history.

(56) References Cited

U.S. PATENT DOCUMENTS 5,850,682 A 12/1998 Ushiro
7,839,651 B2 * 11/2010 Nishizawa ..... H01F 17/0006 361/761

(Continued)

FOREIGN PATENT DOCUMENTS

CN 1407564 A 4/2003
CN 102449710 A 5/2012

(Continued)

OTHER PUBLICATIONS

Japanese Office Action dated Dec. 15, 2015 issued in Japanese Patent Application No. 2014-177796 (English translation).

(Continued)

*Primary Examiner* — Elvin G Enad
*Assistant Examiner* — Kazi Hossain
(74) *Attorney, Agent, or Firm* — McDermott Will & Emery LLP

(57) ABSTRACT

A chip electronic component may include: a magnetic body; and internal coil parts buried in the magnetic body. The magnetic body includes: a core layer including the internal coil parts; and upper and lower cover layers disposed on upper and lower portions of the core layer, respectively, the core layer having a level of magnetic permeability different from that of at least one of the upper and lower cover layers.

9 Claims, 6 Drawing Sheets

(51) Int. Cl.

| | |
|---|---|
| ***H01F 27/255*** | (2006.01) |
| ***H01F 17/00*** | (2006.01) |
| ***H01F 27/29*** | (2006.01) |
| *H01F 3/10* | (2006.01) |

(56) References Cited

U.S. PATENT DOCUMENTS

| | | | | |
|---|---|---|---|---|
| 2003/0048167 | A1 | 3/2003 | Inoue et al. | |
| 2010/0289609 | A1* | 11/2010 | Liao | H01F 17/04 336/221 |
| 2012/0105188 | A1 | 5/2012 | Lim et al. | |
| 2013/0033347 | A1* | 2/2013 | Matsuura | H01F 17/0033 336/83 |
| 2013/0038419 | A1* | 2/2013 | Kobayashi | H01F 17/0013 336/200 |
| 2013/0127576 | A1* | 5/2013 | Hachiya | H01F 27/255 336/200 |
| 2013/0249662 | A1 | 9/2013 | Tonoyama et al. | |
| 2014/0002221 | A1* | 1/2014 | Shin | H01F 17/04 336/83 |
| 2014/0184374 | A1* | 7/2014 | Park | H01F 27/255 336/83 |
| 2015/0155084 | A1* | 6/2015 | Kim | H01F 1/22 174/260 |

FOREIGN PATENT DOCUMENTS

| | | | |
|---|---|---|---|
| JP | 2007-67214 | A | 3/2007 |
| JP | 2008-166455 | A | 7/2008 |
| JP | 2009-049335 | A | 3/2009 |
| JP | 2009-176836 | A | 8/2009 |
| JP | 2011-249836 | A | 12/2011 |
| JP | 2013-55232 | A | 3/2013 |
| JP | 2013055232 | * | 3/2013 |
| JP | 2013-110171 | A | 6/2013 |
| JP | 2013-201374 | A | 10/2013 |
| KR | 2013-0016033 | A | 2/2013 |

OTHER PUBLICATIONS

Korean Notice of Office Action issued in Application No. 10-2014-0077155 dated Apr. 20, 2015, with English Translation.

Chinese Office Action dated Oct. 10, 2016 issued in Chinese Patent Application No. 201410486133.4 (with English translation).

* cited by examiner

CHIP ELECTRONIC COMPONENT AND METHOD OF MANUFACTURING THE SAME

CROSS-REFERENCE TO RELATED APPLICATION

This application claims the benefit of Korean Patent Application No. 10-2014-0077155 filed on Jun. 24, 2014, with the Korean Intellectual Property Office, the disclosure of which is incorporated herein by reference.

BACKGROUND

The present disclosure relates to a chip electronic component and a method of manufacturing the same.

An inductor, a chip electronic component, is a representative passive element configuring an electronic circuit together with a resistor and a capacitor to remove noise.

A thin type inductor may be manufactured by stacking, pressing, and curing magnetic sheets formed by mixing a magnetic powder and a resin with each other after forming an internal coil pattern part.

RELATED ART DOCUMENT (Patent Document 1) Japanese Patent Laid-Open Publication No. 2008-166455

SUMMARY

An exemplary embodiment in the present disclosure may provide a chip electronic component capable of having improved inductance and quality (Q) factor characteristics, and a method of manufacturing the same.

According to an exemplary embodiment in the present disclosure, a chip electronic component may include: a magnetic body; and internal coil parts buried in the magnetic body, wherein the magnetic body includes first and second magnetic material layers having different magnetic permeabilities.

The magnetic body may include a core layer including the internal coil parts; and upper and lower cover layers disposed on upper and lower portions of the core layer, respectively, the core layer having a level of magnetic permeability different from that of at least one of the upper and lower cover layers.

BRIEF DESCRIPTION OF DRAWINGS

The above and other aspects, features and other advantages in the present disclosure will be more clearly understood from the following detailed description taken in conjunction with the accompanying drawings, in which.

DETAILED DESCRIPTION

Figure 1:
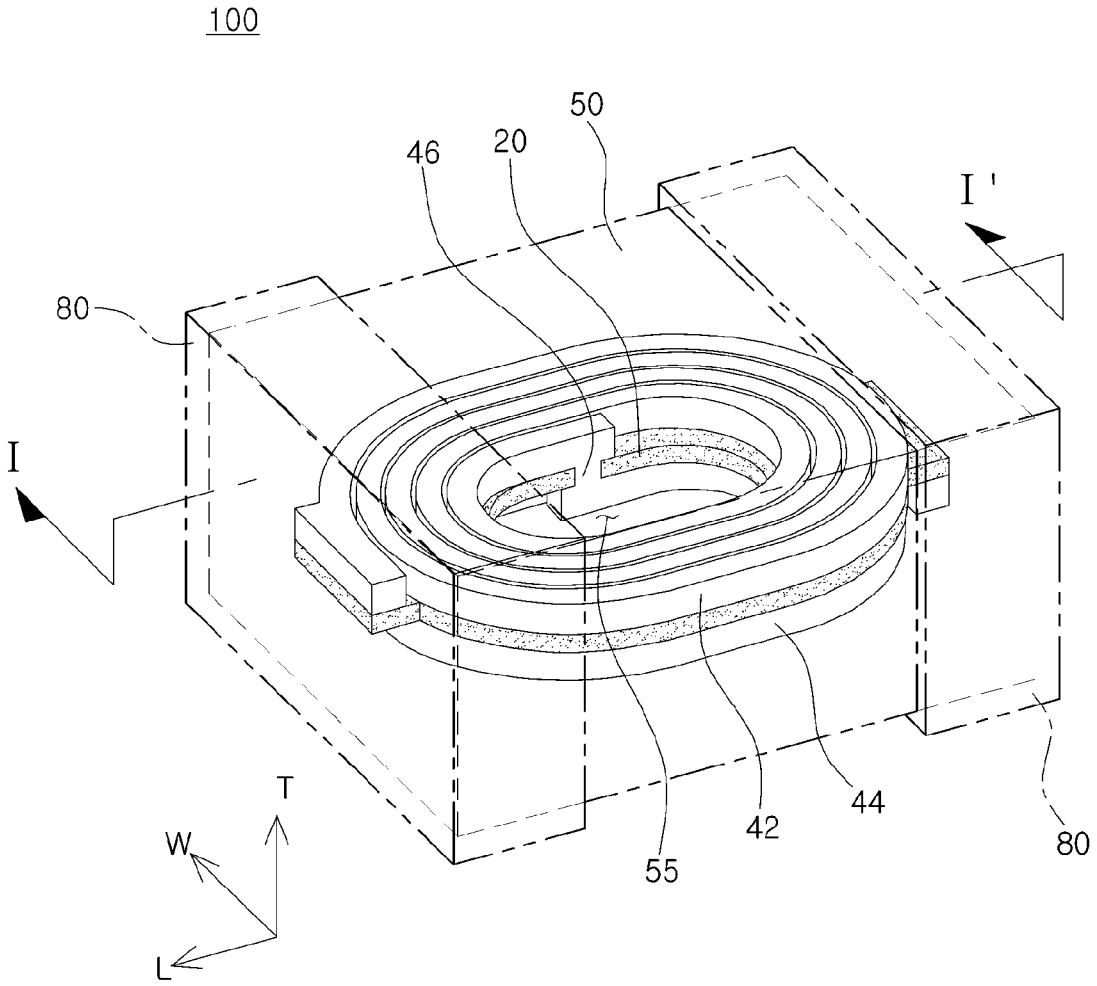
FIG. 1 is a schematic perspective view illustrating a chip electronic component according to an exemplary embodiment in the present disclosure, in which internal coil pattern parts thereof are shown.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment in the present disclosure, particularly, a thin type inductor will be described. However, the present disclosure is not necessarily limited thereto.

FIG. 1 is a schematic perspective view illustrating a chip electronic component according to an exemplary embodiment in the present disclosure, in which internal coil pattern parts thereof are shown.

Referring to FIG. 1, a thin type inductor 100 used in a power line of a power supply circuit may be disclosed as an example of a chip electronic component.

The chip electronic component provided as the thin type inductor 100 according to an exemplary embodiment in the present disclosure may include a magnetic body 50, internal coil parts 42 and 44 buried in the magnetic body 50, and external electrodes 80 disposed on outer surfaces of the magnetic body 50 and electrically connected to the internal coil parts 42 and 44.

In the chip electronic component 100 according to an exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may form the exterior of the thin type inductor 100 and contain, for example, ferrite or metal magnetic particles, but is not limited thereto. That is, the magnetic body 50 may contain any material having magnetic properties.

The metal magnetic particles may be an alloy containing one or more selected from a group consisting of Fe, Si, Cr, Al, and Ni. For example, the metal magnetic particles may include Fe—Si—B—Cr based amorphous metal particles, but are not limited thereto.

The metal magnetic particles may be included in a form in which they are dispersed on a polymer such as an epoxy resin, polyimide, or the like.

An insulating substrate 20 disposed in the magnetic body 50 may be, for example, a polypropylene glycol (PPG) substrate, a ferrite substrate, a metal based soft magnetic substrate, or the like.

The insulating substrate 20 may have a hole formed in a central portion thereof to penetrate through the central portion, and the hole may be filled with a magnetic material such as ferrite, a metal magnetic particle, or the like, to form a central part 55. The central part 55 filled with the magnetic material may be formed, such that an inductance L may be improved.

The internal coil part 42 having coil patterns may be formed on one surface of the insulating substrate 20, and the internal coil part 44 having coil patterns may also be formed on the other surface of the insulating substrate 20.

The internal coil parts 42 and 44 may include the coil patterns formed in a spiral shape, and the internal coil parts 42 and 44 formed on one surface and the other surface of the insulating substrate 20 may be electrically connected to each other through a via electrode 46 formed in the insulating substrate 20.

The internal coil parts 42 and 44 and the via electrode 46 may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof, and the like.

One end portion of the internal coil part 42 formed on one surface of the insulating substrate 20 may be exposed to one end surface of the magnetic body 50 in a length direction thereof, and one end portion of the internal coil part 44 formed on the other surface of the insulating substrate 20 may be exposed to the other end surface of the magnetic body 50 in the length direction thereof.

The external electrodes 80 may be formed on both end surfaces of the magnetic body 50 in the length direction thereof, respectively, to be connected to the internal coil parts 42 and 44 exposed to both end surfaces of the magnetic body 50 in the length direction thereof, respectively.

The external electrodes 80 may be formed of a metal having excellent electrical conductivity, for example, nickel (Ni), copper (Cu), tin (Sn), or silver (Ag), or an alloy thereof, and the like.

Figure 2:
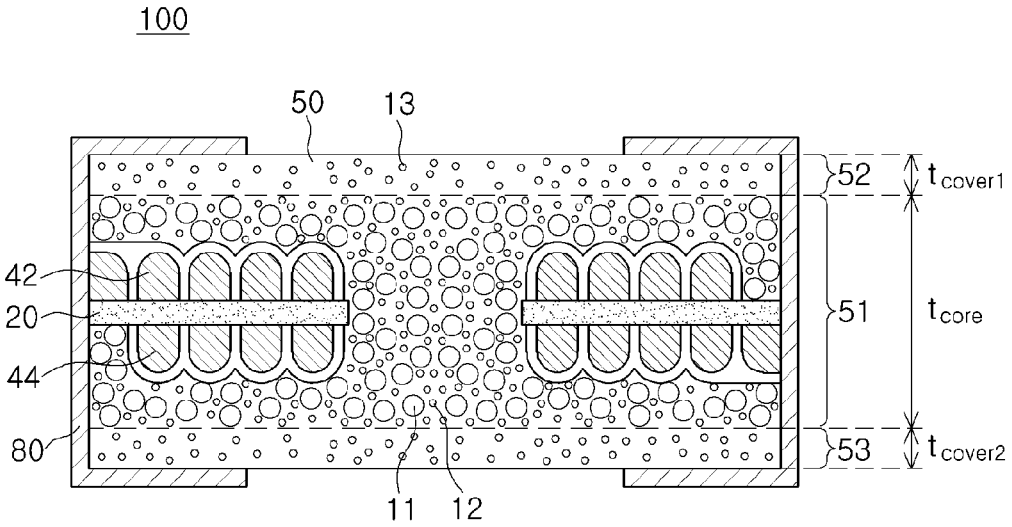
FIG. 2 is a cross-sectional view taken along line I-I' of FIG. 1.

FIG. 2 is a cross-sectional view taken along line I-I' of FIG. 1.

Referring to FIG. 2, the magnetic body 50 according to an exemplary embodiment in the present disclosure may contain metal magnetic particles 11 to 13 and may be divided into first and second magnetic material layers having different magnetic permeabilities.

For example, the magnetic body 50 may include a core layer 51 including the internal coil parts 42 and 44 and upper and lower cover layers 52 and 53 disposed on and below the core layer 51, respectively.

Here, the core layer 51 may have a magnetic permeability different from that of at least one of the upper and lower cover layers 52 and 53.

The core layer 51 and the upper and lower cover layers 52 and 53 may be controlled to have different magnetic permeabilities by making a difference between packing factors of the metal magnetic particles 11 to 13. However, the present disclosure is not limited thereto. That is, any method capable of controlling magnetic permeabilities to be different from each other may be applied.

For example, a difference between magnetic permeabilities of the core layer 51 and the upper or lower cover layer 52 or 53 may be 10 to 40 H·m.

According to an exemplary embodiment in the present disclosure, the core layer 51 may have a level of magnetic permeability greater than those of the upper cover layer 52 and the lower cover layer 53.

As shown in FIG. 2, the core layer 51 may contain mixtures of first metal magnetic particles 11, coarse powder particles, and second metal magnetic particles 12, fine powder particles having an average particle size smaller than that of the first metal magnetic particles 11.

The first metal magnetic particles 11 having a large average particle size may implement a high level of magnetic permeability. In addition, the first metal magnetic particles 11, coarse powder particles, and the second metal magnetic particles 12, fine powder particles, may be mixed with each other to improve a packing factor, thereby further improving a magnetic permeability and resulting in an increase in a quality (Q) factor.

The upper and lower cover layers 52 and 53 may contain third metal magnetic particles 13, fine powder particles.

Since the third metal magnetic particles 13, fine powder particles contained in the upper and lower cover layers 52 and 53 may exhibit a low level of magnetic permeability, but are a low loss material, they may serve to complement core loss increased due to the use of the high magnetic permeability material in the core layer 51.

That is, the high magnetic permeability material may be used in the core layer 51 in which the central part 55 having a magnetic flux concentrated thereon is positioned, and the increase in the core loss due to the high magnetic permeability material may be alleviated by using the low loss material in the upper and lower cover layers 52 and 53. Therefore, inductance and Q-factor characteristics may be improved.

In addition, the upper and lower cover layers 52 and 53 are formed of the third metal magnetic particles 13, which are fine powder particles, whereby a surface roughness of the magnetic body 50 may be improved and a plating spreading phenomenon due to coarse powder particles may be improved.

In the case of using coarse metal magnetic particles in order to implement a high level of magnetic permeability, defects that the coarse metal magnetic particles are exposed to the surface of the magnetic body 50, and a plating layer may be formed on the exposed portion of the coarse metal magnetic particles in a plating process of forming the external electrode may occur.

However, in an exemplary embodiment, the core layer 51 contains the first metal magnetic particles 11, coarse powder particles, in order to implement a high level of magnetic permeability, and the upper and lower cover layers 52 and 53 contain the third metal magnetic particles 13, fine powder particles, whereby a magnetic permeability may be improved and a plating spreading defect may be improved.

A particle size of the first metal magnetic particles 11, coarse powder particles, in the core layer 51, may be 11 μm to 53 μm, and a particle size of the second metal magnetic particles 12, the fine powder particles, in the core layer 51, may be 0.5 μm to 6 μm.

A packing factor of the metal magnetic particles in the core layer 51 may be 70% to 85%.

A particle size of the third metal magnetic particles 13, fine powder particles, in the upper and lower cover layers 52 and 53, may be 0.5 μm to 6 μm, and packing factors of the metal magnetic particles in the upper and lower cover layers 52 and 53 may be 55% to 70%.

A thickness $t_{core}$ of the core layer 51 may be 0.5 to 10 times a thickness $t_{cover1}$ or $t_{cover2}$ of the upper cover layer 52 or the lower cover layer 53.

The core layer 51 and the upper cover layer 52 or the lower cover layer 53 satisfy the above-mentioned thickness ratio, whereby inductance and Q-factor characteristics may be improved.

Figure 3:
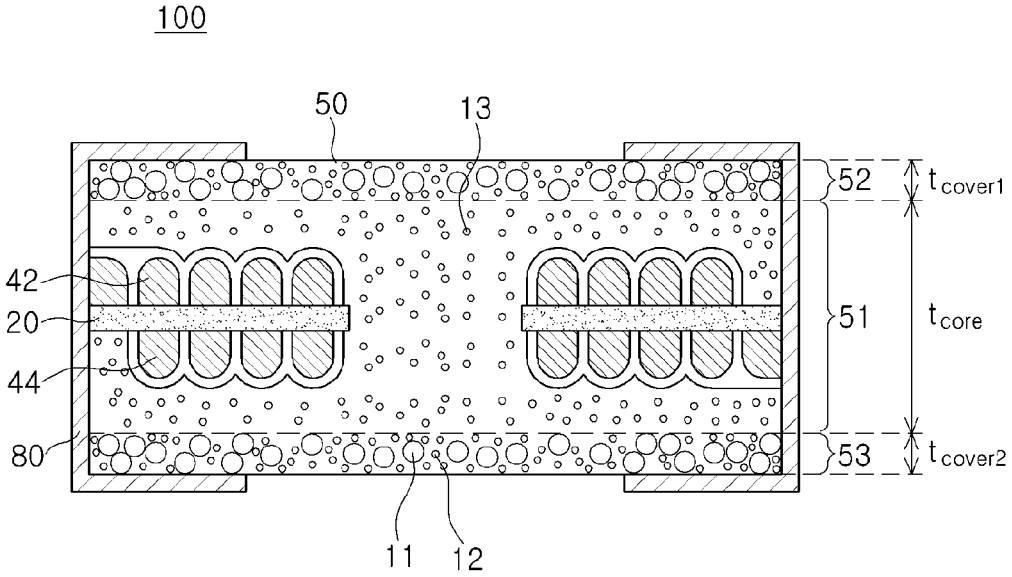
FIG. 3 is a cross-sectional view of a chip electronic component according to another exemplary embodiment in the present disclosure in a length and thickness (L-T) direction.
Figure 4:
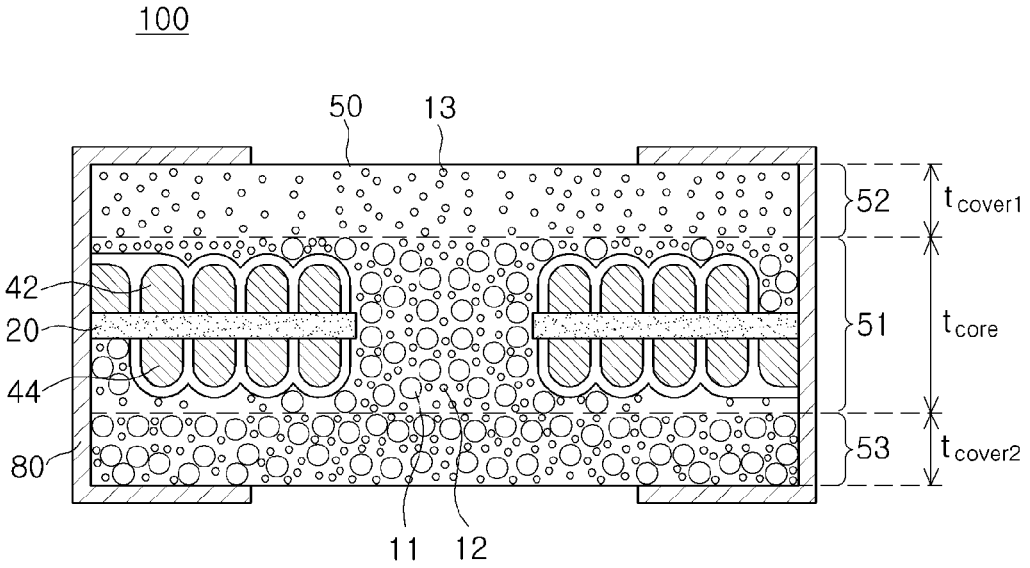
FIG. 4 is a cross-sectional view of a chip electronic component according to another exemplary embodiment in the present disclosure in a length and thickness (L-T) direction.
Figure 5:
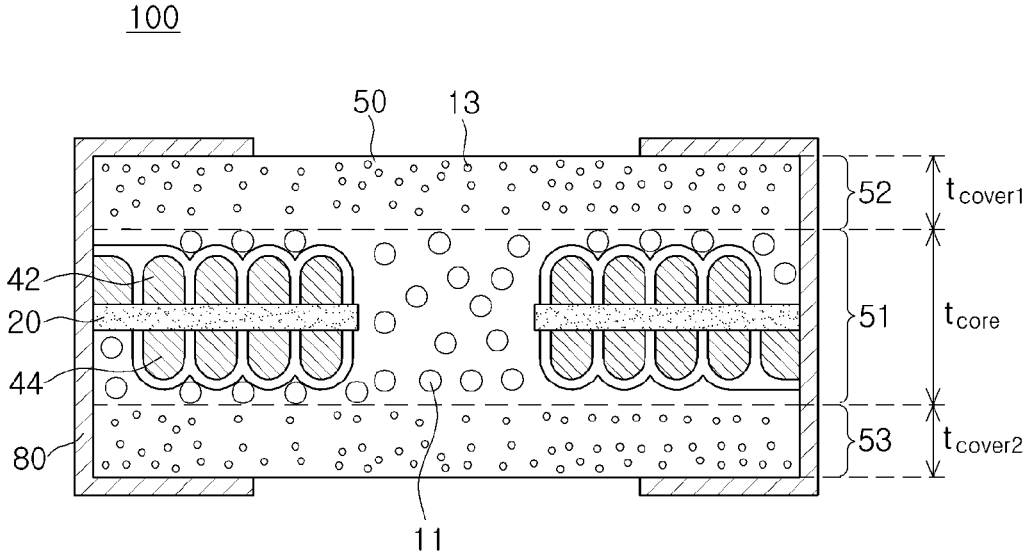
FIG. 5 is a cross-sectional view of a chip electronic component according to another exemplary embodiment in the present disclosure in a length and thickness (L-T) direction.

FIG. 3 is a cross-sectional view of a chip electronic component according to another exemplary embodiment in the present disclosure in a length and thickness (L-T) direction. FIG. 4 is a cross-sectional view of a chip electronic component according to another exemplary embodiment in the present disclosure in a length and thickness (L-T) direction. FIG. 5 is a cross-sectional view of a chip electronic component according to another exemplary embodiment in the present disclosure in a length and thickness (L-T) direction.

According to another exemplary embodiment in the present disclosure, the core layer 51 may have a level of magnetic permeability lower than those of the upper cover layer 52 and the lower cover layer 53.

Referring to FIG. 3, the core layer 51 may contain the third metal magnetic particles 13, fine powder particles, and the upper and lower cover layers 52 and 53 may contain mixtures of first metal magnetic particles 11, coarse powder particles, and second metal magnetic particles 12, fine powder particles having an average particle size smaller than that of the first metal magnetic particles 11.

The first metal magnetic particles 11 having a large average particle size may implement a high level of magnetic permeability. In addition, the first metal magnetic particles 11, coarse powder particles, and the second metal magnetic particles 12, fine powder particles, may be mixed with each other to improve a packing factor, thereby further improving a magnetic permeability and allowing for an increase in a quality (Q) factor.

Since the third metal magnetic particles 13, fine powder particles, exhibit a low level of magnetic permeability, but are a low loss material, they may serve to complement core loss increased due to use of the high magnetic permeability material, coarse powder particles.

The particle size of the third metal magnetic particles 13, fine powder particles, in the core layer 51, may be 0.5 μm to 6 μm, and a packing factor of the metal magnetic particles in the core layer 51 may be 55% to 70%.

The particle size of the first metal magnetic particles 11, coarse powder particles, in the upper and lower cover layers 52 and 53 may be 11 μm to 53 μm, and the particle size of the second metal magnetic particles 12, fine powder particles, in the upper and lower cover layers 52 and 53 may be 0.5 μm to 6 μm.

A packing factor of the metal magnetic particles in the upper and lower cover layers 52 and 53 may be 70% to 85%.

According to another exemplary embodiment in the present disclosure, the core layer 51 may have a level of magnetic permeability greater than that of the upper cover layer 52 or the lower cover layer 53.

Referring to FIG. 4, the core layer 51 and the lower cover layer 53 may contain mixtures of the first metal magnetic particles 11, coarse powder particles, and the second metal magnetic particles 12, fine powder particles having an average particle size smaller than that of the first metal magnetic particles 11, and the upper cover layer 52 may contain the third metal magnetic particles 13, fine powder particles.

As described above, the chip electronic component according to an exemplary embodiment in the present disclosure is not limited to having a structure in which both the upper and lower cover layers 52 and 53 have levels of magnetic permeability different from that of the core layer 51, but may have a structure in which the core layer 51 has a level of magnetic permeability different from that of at least one of the upper and lower cover layers 52 and 53.

Although FIG. 4 illustrates a structure in which the core layer 51 has a level of magnetic permeability greater than that of the upper cover layer 52, the chip electronic component according to an exemplary embodiment in the present disclosure is not limited thereto. The chip electronic component according to an exemplary embodiment in the present disclosure may also have a structure in which the core layer 51 has a level of magnetic permeability greater than that of the lower cover layer 53 or a structure in which the core layer 51 has a level of magnetic permeability lower than that of the upper or lower cover layer 52 or 53.

Referring to FIG. 5, the core layer 51 may contain the first metal magnetic particles 11, coarse powder particles, and the upper and lower cover layers 52 and 53 may contain the third metal magnetic particles 13, fine powder particles.

The first metal magnetic particles 11 having a large average particle size may implement a high level of magnetic permeability. Meanwhile, since the third metal magnetic particles 13, fine powder particles, may exhibit a low level of magnetic permeability, but are a low loss material, they may serve to complement core loss increased due to the use of the high magnetic permeability material in the core layer 51.

When fine metal magnetic particles are mixed with the first metal magnetic particles 11 in the core layer 51, a packing factor may be improved to allow for an increase in magnetic permeability. However, the present disclosure is not limited thereto. That is, the core layer 51 may contain only the first metal magnetic particles 11, coarse powder particles, as shown in FIG. 5.

Method of Manufacturing Chip Electronic Component

Figure 6:
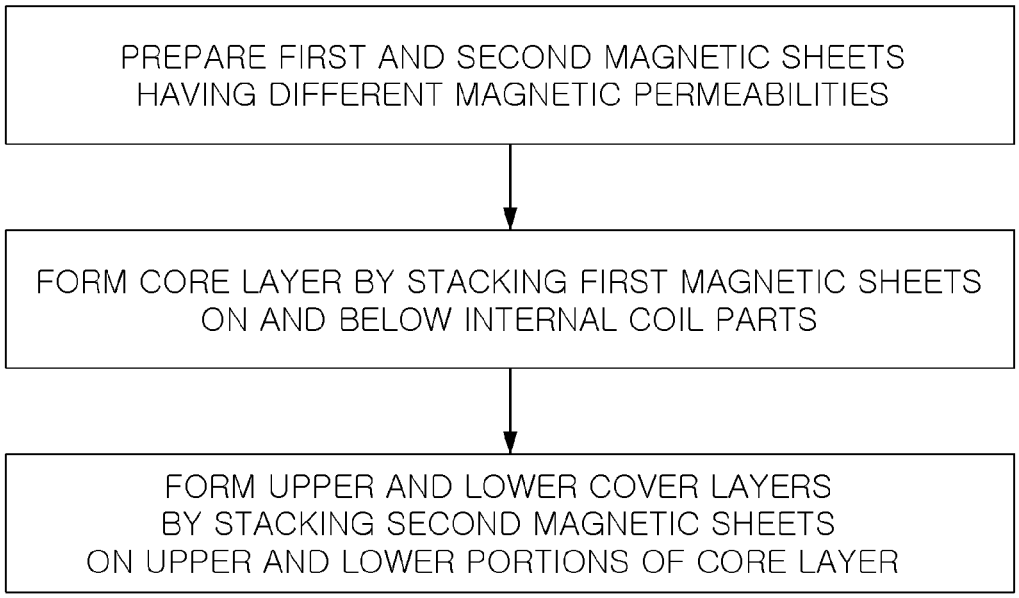
FIG. 6 is a flow chart showing a manufacturing process of a chip electronic component according to an exemplary embodiment in the present disclosure.

FIG. 6 is a flow chart showing a manufacturing process of a chip electronic component according to an exemplary embodiment in the present disclosure. FIGS. 7A through 7D are views illustrating the manufacturing process of a chip electronic component according to an exemplary embodiment in the present disclosure.

Referring to FIG. 6, first and second magnetic sheets having different magnetic permeabilities may be first prepared.

The first and second magnetic sheets may be manufactured in sheet shapes by mixing magnetic powder particles, for example, metal magnetic particles and organic materials such as a binder, a solvent, and the like, to prepare a slurry, applying the slurry onto carrier films at a thickness of several tens μm, and then drying the films by a doctor blade method.

Here, the first and second magnetic sheets may be controlled to have different magnetic permeabilities by making a difference between packing factors of the metal magnetic particles. However, the present disclosure is not necessarily limited thereto. That is, any method capable of controlling magnetic permeabilities to be different from each other may be applied.

According to an exemplary embodiment in the present disclosure, the first magnetic sheets may be formed by mixing the first metal magnetic particles 11, coarse powder particles, with the second metal magnetic particles 12, fine powder particles having an average particle size smaller than that of the first metal magnetic particles 11, and the second magnetic sheets may be formed of the third metal magnetic particles 13, fine powder particles.

In this case, in the first magnetic sheets, the first metal magnetic particles 11 having a large average particle size may implement a high level of magnetic permeability. In addition, the first metal magnetic particles 11, coarse powder particles, and the second metal magnetic particles 12, fine powder particles, may be mixed with each other to improve a packing factor, thereby implementing a further increased level of magnetic permeability. That is, the first magnetic sheets may have a level of magnetic permeability greater than that of the second magnetic sheets formed of the third metal magnetic particles 13, fine powder particles.

The particle size of the first metal magnetic particles 11, coarse powder particles, in the first magnetic sheets may be 11 μm to 53 μm, and the particle size of the second metal magnetic particles 12, fine powder particles, in the first magnetic sheets may be 0.5 μm to 6 μm. The particle size of the third metal magnetic particles 13, fine powder particles, in the second magnetic sheets may be 0.5 μm to 6 μm.

According to another exemplary embodiment in the present disclosure, the first magnetic sheets may be formed of the third metal magnetic particles 13, fine powder particles, and the second magnetic sheets may be formed by mixing the first metal magnetic particles 11, coarse powder particles, with the second metal magnetic particles 12, fine powder particles having an average particle size smaller than that of the first metal magnetic particles 11.

In this case, the first magnetic sheets may have a level of magnetic permeability lower than that of the second magnetic sheet.

The particle size of the third metal magnetic particles 13, fine powder particles, in the first magnetic sheets may be 0.5 μm to 6 μm. The particle size of the first metal magnetic particles 11, coarse powder particles, in the second magnetic sheets may be 11 μm to 53 μm, and the particle size of the second metal magnetic particles 12, fine powder particles, in the second magnetic sheets may be 0.5 μm to 6 μm.

Next, the core layer 51 may be formed by stacking the first magnetic sheets on and below the internal coil parts 42 and 44.

Figure 7A:
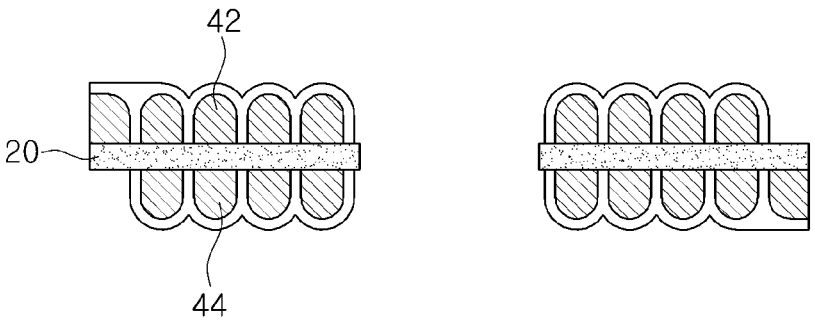
FIGS. 7A through 7D are views illustrating the manufacturing process of a chip electronic component according to an exemplary embodiment in the present disclosure.

Referring to FIG. 7A, the internal coil parts 42 and 44 may be first formed on one surface and the other surface of the insulating substrate 20, respectively.

A method of forming the internal coil parts 42 and 44 may be, for example, an electroplating method, but is not limited thereto. The internal coil parts 42 and 44 may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof, and the like.

Figure 7B:
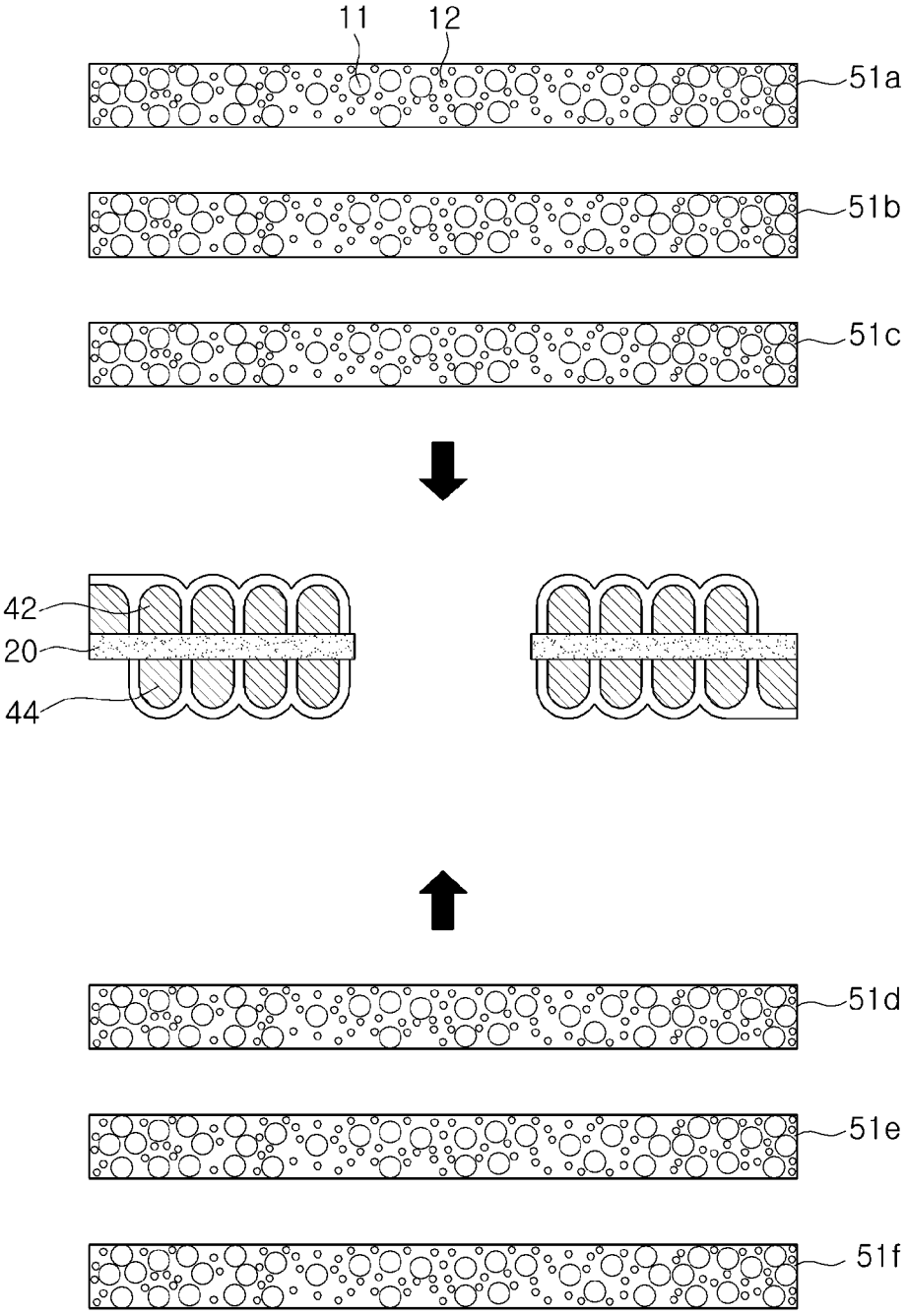

Referring to FIG. 7B, a plurality of first magnetic sheets 51*a* to 51*f* may be stacked on and below the internal coil parts 42 and 44.

The plurality of first magnetic sheets 51*a* to 51*f* may be stacked and be compressed by a laminate method or a hydrostatic pressure pressing method to form the core layer 51.

Although FIG. 7B illustrates an exemplary embodiment in which the first magnetic sheets 51*a* to 51*f* contain mixtures of the first metal magnetic particles 11, coarse powder particles, and the second metal magnetic particles 12, fine powder particles having an average particle size smaller than that of the first metal magnetic particles 11, the present disclosure is not limited thereto and may be implemented in another exemplary embodiment described above.

Next, the upper or lower cover layer 52 or 53 may be formed by stacking the second magnetic sheets on at least one of upper and lower portions of the core layer 51.

Figure 7C:
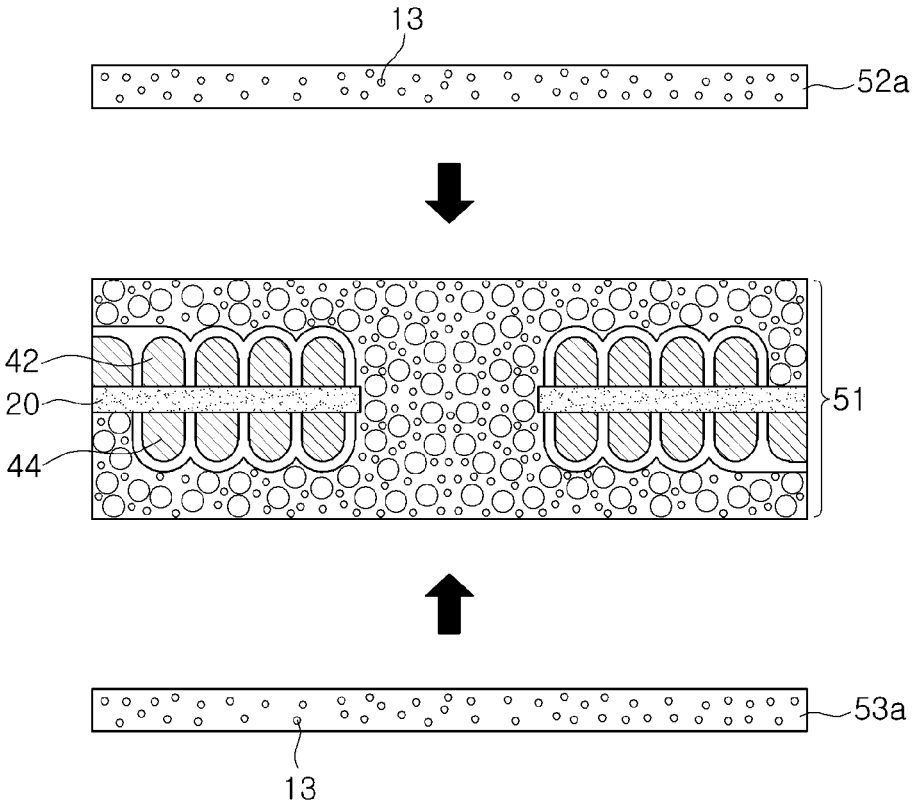

Referring to FIG. 7C, second magnetic sheets 52*a* and 53*a* may be stacked on the upper and lower portions of the core layer 51.

The second magnetic sheets 52*a* and 53*a* may be stacked and be compressed by a laminate method or a hydrostatic pressure pressing method to form the upper and lower cover layers 52 and 53.

Although FIG. 7C illustrates an exemplary embodiment in which the second magnetic sheets 52*a* and 53*a* contain the third metal magnetic particles 13, fine powder particles, the present disclosure is not limited thereto and may be implemented in another exemplary embodiment described above. In addition, a plurality of second magnetic sheets may be stacked on the respective upper and lower portions of the core layer 51, or may be stacked on at least one of the upper and lower portions of the core layer 51.

Figure 7D:
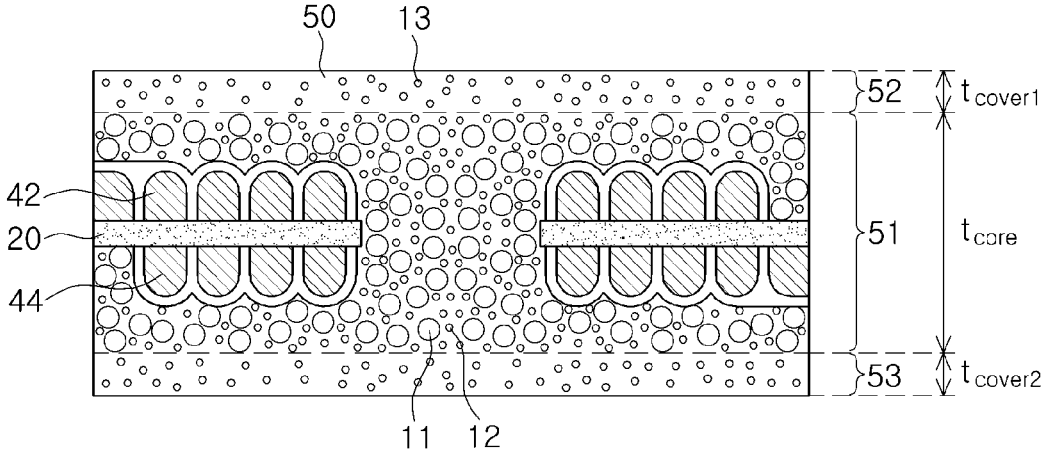

Referring to FIG. 7D, the magnetic body 50 including the core layer 51 and the upper and lower cover layers 52 and 53 may be formed. In the magnetic body 50 formed as described above, the core layer 51 may have a level of magnetic permeability different from those of the upper and lower cover layers 52 and 53.

Through a process of forming the magnetic body by preparing the first and second magnetic sheets having different magnetic permeabilities and stacking the magnetic sheets having the different magnetic permeabilities, the magnetic body divided into magnetic material layers having different magnetic permeabilities may be easily implemented.

The first magnetic sheets 51*a* to 51*f* and the second magnetic sheets 52*a* and 53*a* may be stacked such that the thickness $t_{core}$ of the core layer 51 is 0.5 to 10 times the thickness $t_{cover1}$ or $t_{cover2}$ of the upper cover layer 52 or the lower cover layer 53.

The core layer 51 and the upper cover layer 52 or the lower cover layer 53 may satisfy the above-mentioned thickness ratio, whereby inductance and Q-factor characteristics may be improved.

A description of features that are the same as those of the chip electronic component according to an exemplary embodiment in the present disclosure described above will be omitted.

As set forth above, according to exemplary embodiments of the present disclosure, a high degree of inductance may be secured, and excellent Q-factor characteristics may be implemented.

While exemplary embodiments have been shown and described above, it will be apparent to those skilled in the art that modifications and variations could be made without departing from the scope of the present invention e as defined by the appended claims.

What is claimed is:

1. A chip electronic component comprising:

a magnetic body; and internal coil parts buried in the magnetic body, wherein the magnetic body includes:

a core layer including the internal coil parts; and upper and lower cover layers disposed on upper and lower portions of the core layer, respectively, the core layer having a level of magnetic permeability different from that of at least one of the upper and lower cover layers, wherein the core layer contains first metal magnetic particles and second metal magnetic particles having an average particle size smaller than that of the first metal magnetic particles, a particle size of the first metal magnetic particles is 11 μm to 53 μm and a particle size of the second metal magnetic particles is 0.5 μm to 6

μm, and the upper or lower cover layer contains third metal magnetic particles having a particle size of 0.5 μm to 6 μm.

2. The chip electronic component of claim 1, wherein the core layer has a level of magnetic permeability greater than that of the upper or lower cover layer.

3. The chip electronic component of claim 1, wherein the core layer has a level of magnetic permeability lower than that of the upper or lower cover layer.

4. The chip electronic component of claim 1, wherein a difference between the magnetic permeabilities of the core layer and the upper or lower cover layer is 10 to 40 H/m.

5. The chip electronic component of claim 1, wherein the magnetic body contains metal magnetic particles, and a packing factor of the metal magnetic particles in the core layer is different from that of the metal magnetic particles in the upper or lower cover layer.

6. The chip electronic component of claim 1, wherein a packing factor of metal magnetic particles in the core layer is 70% to 85%, and a packing factor of metal magnetic particles in the upper or lower cover layer is 55% to 70%.

7. The chip electronic component of claim 1, wherein a packing factor of metal magnetic particles in the core layer is 55% to 70%, and a packing factor of metal magnetic particles in the upper or lower cover layer is 70% to 85%.

8. The chip electronic component of claim 1, wherein a thickness of the core layer is 0.5 to 10 times a thickness of the upper or lower cover layer.

9. A chip electronic component comprising:

a magnetic body containing metal magnetic particles; and internal coil parts disposed in the magnetic body, wherein the magnetic body includes first and second magnetic material layers having different magnetic permeabilities, wherein the core layer contains first metal magnetic particles and second metal magnetic particles having an average particle size smaller than that of the first metal magnetic particles, a particle size of the first metal magnetic particles is 11 μm to 53 μm and a particle size of the second metal magnetic particles is 0.5 μm to 6 μm, and the upper or lower cover layer contains third metal magnetic particles having a particle size of 0.5 μm to 6 μm.

* * * * *